US008163683B2

(12) United States Patent
Haga et al.

(10) Patent No.: US 8,163,683 B2
(45) Date of Patent: Apr. 24, 2012

(54) POUR POINT DEPRESSANT FOR LUBRICANT

(75) Inventors: Naoki Haga, Yokosuka (JP); Akiyuki Hiraide, Yokosuka (JP)

(73) Assignee: Toho Chemical Industry Co., Ltd., Tokyo (JP)

( * ) Notice: Subject to any disclaimer, the term of this patent is extended or adjusted under 35 U.S.C. 154(b) by 149 days.

(21) Appl. No.: 12/451,897

(22) PCT Filed: Jun. 6, 2008

(86) PCT No.: PCT/JP2008/060461

§ 371 (c)(1),
(2), (4) Date: Dec. 4, 2009

(87) PCT Pub. No.: WO2008/152984

PCT Pub. Date: Dec. 18, 2008

(65) Prior Publication Data

US 2010/0120641 A1 May 13, 2010

(30) Foreign Application Priority Data

Jun. 8, 2007 (JP) ..... 2007-152519

(51) Int. Cl.
*C10M 111/04* (2006.01)
*C10M 145/14* (2006.01)

(52) U.S. Cl. ..... 508/469; 508/118

(58) Field of Classification Search ..... 508/118, 508/469, 508
See application file for complete search history.

(56) References Cited

U.S. PATENT DOCUMENTS

| | | | | |
|---|---|---|---|---|
| 2,655,479 | A | 10/1953 | Munday et al. | |
| 4,822,508 | A | 4/1989 | Pennewiss et al. | |
| 4,968,444 | A * | 11/1990 | Knoell et al. | 508/262 |
| 6,475,963 | B1 * | 11/2002 | Bloch et al. | 508/467 |
| 2001/0056044 | A1 | 12/2001 | Kinker et al. | |

FOREIGN PATENT DOCUMENTS

| | | |
|---|---|---|
| JP | A 54-70305 | 6/1979 |
| JP | A 60-110790 | 6/1985 |
| JP | A 62-141096 | 6/1987 |
| JP | A 10-298576 | 11/1998 |
| JP | A 10-306291 | 11/1998 |
| JP | A 10-310758 | 11/1998 |
| JP | A 2001-514301 | 9/2008 |

OTHER PUBLICATIONS

International Search Report issued for International Application No. PCT/JP2008/060461 on Sep. 9, 2008 (w/ translation).

* cited by examiner

*Primary Examiner* — Walter D Griffin
*Assistant Examiner* — Francis C Campanell
(74) *Attorney, Agent, or Firm* — Oliff & Berridge, PLC

(57) ABSTRACT

There is provided a pour point depressant for lubricants that has an effect of lowering pour points of both solvent refined base oils and high viscosity index base oils. A pour point depressant for lubricants comprising: a mixture of an alkyl (meth)acrylate polymer (A) that is composed of an alkyl (meth)acrylate containing alkyl groups having an average carbon number ($C_A$) of 12.5 to 13.8, and an alkyl(meth) acrylate polymer (B) that is composed of an alkyl(meth) acrylate containing alkyl groups having an average carbon number ($C_B$) of 13.9 to 15.5.

4 Claims, No Drawings

POUR POINT DEPRESSANT FOR LUBRICANT

TECHNICAL FIELD

The present invention relates to techniques for lowering pour points of lubricants that are characterized by using a particular combination of alkyl(meth)acrylate polymers.

BACKGROUND ART

It is generally known that the viscosity of a lubricant increases with a decrease of temperature, and the lubricant turns into a gel and is completely solidified with passage of time to lose fluidity at lower temperature than the crystallization point of wax contained in a lubricant.

The solidification of a lubricant at low temperature is considered to be attributed to crystallization of wax contained in the lubricant that is paraffin when cooling the lubricant and further to a network structure of the wax due to the cooling. In order to improve the fluidity of a lubricant, a typical method is to remove a wax component contributing to solidification to some extent by a dewaxing process at a certain low temperature, and furthermore to add a pour point depressant. The function of the pour point depressant is considered not to solubilize wax into lubricant, but to inhibit the wax from forming the network structure. In general, addition of a pour point depressant to a lubricant can lower the pour point. As a method for lowering pour points of lubricants by using polymer additives, Patent Document 1 discloses that polyalkyl (meth)acrylates with a limited average alkyl carbon number are used as pour point depressants for lubricants and viscosity index improvers.

By contrast, with social needs of fuel saving in recent years, there is a strong demand for lubricants having low viscosity at low temperature. As one means to meet the demands, high viscosity index base oils or a combination of high viscosity index base oils and common solvent refined base oils or synthetic lubricants have been used. However, it is known that, since the high viscosity index base oil and the solvent refined base oil are different in molecular structures, a pour point depressant having an effect when used for the solvent refined base oil does not always have an effect on the high viscosity index base oil. As pour point depressants specialized in lubricants using the high viscosity index base oils, combinations of particular polyalkyl(meth)acrylates have been developed in Patent Documents 2 and 3. However, the combination gives no satisfactory effect on the solvent refined base oils, so that the combination is not necessarily effective for lubricants in which the solvent refined base oils and high viscosity index base oils are blended at any given ratio. In view of the above, although pour point depressants for lubricants effective for both solvent refined base oils and high viscosity index base oils are required, pour point depressants for lubricants with quite satisfactory performance have not been obtained.

[Patent Document 1]

U.S. Pat. No. 2,655,479

[Patent Document 2]

Japanese Patent Application Publication No. JP-A-54-70305

[Patent Document 3]

Japanese Patent Application Publication No. JP-A-10-310758

DISCLOSURE OF THE INVENTION

Problem to be Solved by the Invention

It is an object of the present invention to provide a pour point depressant for lubricants that has an effect of lowering pour points of both solvent refined base oils and high viscosity index base oils, which is absent in related art.

Means for Solving the Problem

The inventors of the present invention have carried out intensive studies, and as a result, have found that a small addition amount of a mixture of alkyl(meth)acrylate polymers with a particular alkyl average carbon number has an effect of lowering pour points of both high viscosity index base oils that have been used from social needs in recent years and common solvent refined base oils, and the present invention has been accomplished based on the finding.

That is, the present invention relates to a pour point depressant for lubricants including a mixture of an alkyl(meth) acrylate polymer (A) that is composed of an alkyl(meth) acrylate containing alkyl groups having an average carbon number ($C_A$) of 12.5 to 13.8, and an alkyl(meth)acrylate polymer (B) that is composed of an alkyl(meth)acrylate containing alkyl groups having an average carbon number ($C_B$) of 13.9 to 15.5.

It is desirable that the alkyl(meth)acrylate polymer (A) included in the pour point depressant for lubricants be a polymer in which, with the alkyl(meth)acrylate that composes the polymer (A) being 100% by mass, 30 to 80% by mass of the alkyl (meth)acrylate is composed of an alkyl (meth)acrylate containing alkyl groups having a carbon number of 13 or less, and that the alkyl(meth)acrylate polymer (B) be a polymer in which, with the alkyl(meth)acrylate that composes the polymer (B) being 100% by mass, 5 to 60% by mass of the alkyl(meth)acrylate is composed of an alkyl (meth)acrylate containing alkyl groups having a carbon number of 13 or less.

Furthermore, it is desirable that the relation between $C_A$ and $C_B$ satisfy Formula (1):

$$0.5 \leqq C_B - C_A \leqq 2.5 \quad (1).$$

Moreover, it is desirable that the mass ratio of the polymer (A) and the polymer (B) be (A)/(B)=1/99 to 99/1.

Moreover, the present invention relates to a lubricant including 0.01% by mass to 5.0% by mass of the pour point depressant for lubricants.

BEST MODES FOR CARRYING OUT THE INVENTION

Examples of the alkyl(meth)acrylate according to the present invention include (meth)acrylates having a straight chain and/or branched alkyl group with an alkyl group having a carbon number of 5 to 22 such as octyl(meth)acrylate, decyl (meth)acrylate, dodecyl(meth)acrylate, tridecyl(meth)acrylate, tetradecyl (meth)acrylate, pentadecyl(meth)acrylate, hexadecyl(meth)acrylate, heptadecyl (meth)acrylate, octadecyl(meth)acrylate, nonadecyl(meth)acrylate, eicosyl (meth) acrylate, heneicosyl(meth)acrylate, and docosyl(meth)acrylate. The polymer of the present invention can be obtained by polymerizing one or more alkyl (meth)acrylates described above.

These alkyl(meth)acrylates can be easily manufactured by the esterification reaction of (meth)acrylic acids and natural or synthetic alcohols or the ester-exchange reaction of (meth) acrylic acid esters having a small alkyl carbon number such as methyl(meth)acrylate and natural or synthetic alcohols. When the natural alcohols are used, the obtained alkyl groups are straight chains and have only even carbon numbers. When the synthetic alcohols are used, the obtained alkyl groups are a mixture of straight and branched chains and have both odd and even carbon numbers.

The fluidity depressant for lubricants of the present invention is characterized by a mixture of an alkyl(meth)acrylate polymer (A) that is composed of an alkyl (meth)acrylate containing alkyl groups having an average carbon number ($C_A$) of 12.5 to 13.8, and an alkyl(meth)acrylate polymer (B) that is composed of an alkyl (meth)acrylate containing alkyl groups having an average carbon number ($C_B$) of 13.9 to 15.5. That is, when either the polymer (A) or (B) is absent, the pour point depressant cannot have a sufficiently satisfactory effect on both solvent refined base oils and high viscosity index base oils. The single use of the polymer (A) or (B) has no effect on either of the solvent refined base oils or high viscosity index base oils. However, when both of the polymers are used in combination, the combination of the polymers exerts an effect of lowering pour points of both of the solvent refined base oils and high viscosity index base oils. Accordingly, the presence of a mechanism in which both of the polymers (A) and (B) cooperatively work on wax in a lubricant to inhibit the wax from forming the network structure is inferred.

The average carbon number in the present invention is the total sum of the values obtained by multiplying the carbon number of alkyl groups in each monomer unit composing a polymer by its weight fraction.

The desirable average carbon number ($C_A$) of the alkyl (meth)acrylate polymer (A) is more preferably of 13.0 to 13.8.

Furthermore, the desirable average carbon number ($C_B$) of the alkyl(meth)acrylate polymer (B) is more preferably of 13.9 to 15.0.

The alkyl(meth)acrylate polymer (A) is preferably a polymer in which, with the alkyl(meth)acrylate that composes the polymer being 100% by mass, 30 to 80% by mass, more preferably 40 to 70% by mass of the alkyl(meth)acrylate is composed of an alkyl(meth)acrylate having a carbon number of 13 or less.

Furthermore, the alkyl(meth)acrylate polymer (B) is desirably a polymer in which, with the alkyl(meth)acrylate that composes the polymer being 100% by mass, 5 to 60% by mass, more desirably 30 to 55% by mass of the alkyl(meth) acrylate is composed of an alkyl(meth)acrylate having a carbon number of 13 or less.

In this manner, the pour point depressant for lubricants of the present invention has a different constitution from those of the inventions described in Patent Documents 1 to 3 in point of using a mixture of the polymer (A) and the polymer (B) in which alkyl(meth)acrylates with a particular carbon number is used in a particular ratio.

The polymer (A) and the polymer (13) included in the pour point depressant for lubricants of the present invention may contain polymerizable compounds other than the alkyl(meth) acrylates described above.

Furthermore, in order to obtain an excellent effect on both of the solvent refined base oils and the high viscosity index base oils, the relation between $C_A$ and $C_B$ preferably satisfies Formula (1), and more preferably satisfies Formula (2):

$$0.5 \leqq C_B - C_A \leqq 2.5 \quad (1),$$

$$1.0 \leqq C_B - C_A \leqq 2.0 \quad (2).$$

The mass ratio of the polymer (A) and the polymer (B) is preferably (A)/(B)=1/99 to 99/1, more preferably 10/90 to 90/10, and even more preferably 20/80 to 80/20.

Each of the weight average molecular weights (Mw) of the polymers (A) and (B) is preferably 50,000 to 300,000. When the weight average molecular weight is too low, the performance of lowering pour points may become insufficient, and when the weight average molecular weight is too high, the solubility to lubricants becomes low and the viscosity becomes high. Because of this, handling problems may occur. Here, the molecular weight is a value measured by GPC (gel permeation chromatography) with polystyrene used for preparing a calibration curve.

The pour point depressant for lubricants of the present invention is a mixture of (meth)acrylate copolymers containing alkyl groups having a particular average carbon number. However, the copolymer may be, as necessary, synthesized by copolymerization with still other monomers such as N-vinylpyrrolidone, vinylimidazole, and N,N-dialkylaminoalkyl methacrylamide.

The polymer of the present invention can be easily obtained by a general method, and the manufacturing method is not limited. For example, the polymer can be obtained by radical polymerization with a diluent, selected type and amount of an alkyl(meth)acrylate, a polymerization initiator, and a chain transfer agent. Furthermore, the polymer can be obtained by thermal polymerization with a diluent and selected type and amount of an alkyl(meth)acrylate.

Although the use of diluents is optional, when a diluent is used, the molecular weight of polymer is easily controlled. Furthermore, since polymers are viscous, handling problems are often solved. The diluent to be used may be any diluent as long as it is an inactive hydrocarbon, but is required to be compatible with the polymer and lubricant. The amount used of a diluent is preferably about 30% by mass to 400% by macs with respect to an alkyl(meth)acrylate to be polymerized.

Suitable examples of the polymerization initiator include initiators that degrade by heating to generate free radicals, for example, peroxide compounds such as benzoyl peroxide, t-butyl peroctoate, and cumene hydroperoxide and azo compounds such as azobisisobutyronitrile and 2,2'-azobis(2-methylbutanenitrile). The amount used of the polymerization initiator is preferably about 0.2% by mass to 1% by mass with respect to an alkyl(meth)acrylate to be polymerized.

Suitable examples of the chain transfer agent include commonly used agents in the field, for example, α-styrene dimer, dodecyl mercaptan, and ethyl mercaptan. Using the chain transfer agent is optional, but when the chain transfer agent is used, the molecular weight of a polymer can be easily controlled.

The addition amount of the pour point depressant is preferably 0.01% by mass to 5.0% by mass, and more preferably 0.05% by mass to 1.0% by mass with respect to a lubricant.

Examples of the lubricant according to the present invention include, besides solvent refined base oils and high viscosity index base oils, oils used as, for example, a mixture of high viscosity index base oils and solvent refined base oils or a mixture of the base oils described above and synthetic lubricants. The synthetic lubricants are ester lubricants (for example, esters of alcohols such as trimethylolpropane and hexamethylenediol and fatty acids, and an ester of adipic acids and fatty acids) and polyolefin lubricants (for example, PAO series such as decene oligomer).

The high viscosity index base oil generally means a base oil having a viscosity index of 120 or higher and is greatly different from a solvent refined base oil manufactured by usual solvent refining. The high viscosity index base oil contains a component that is i-paraffin isomerized from n-paraffin by hydrogenolysis using a catalyst. For the catalyst for the hydrogenolysis, a noble metal catalyst is generally used. The composition of the base oil containing the isomerized paraffin is greatly different from the composition of a usual solvent refined base oil, so that the viscosity index becomes large.

The lubricant may contain, in addition to the pour point depressant according to the present invention, other additives, for example, a pour point depressant such as an alkyl(meth) acrylate copolymer having an average carbon number out of the range defined in the present invention, antioxidant such as dithiophosphate, detergent dispersant/corrosion inhibitor such as an overbased metal sulfonate, antifoaming agent such as a silicon polymer, and viscosity index improver such as an alkyl(meth)acrylate copolymer, olefin copolymer, and hydrogenated styrene-butadiene copolymer.

A performance test method for pour point depressants is described in the testing methods for pour point of petroleum products, JIS K 2269 and this method is widely used.

EXAMPLES

Hereinafter, the present invention will be described in more detail with reference to Examples and Comparative Examples. The present invention is not limited to these examples. Furthermore, "%" represents "% by mass" otherwise specified in the text.

Synthetic Example 1

To a flask equipped with a stirring apparatus, nitrogen inlet tube, thermometer, and condenser, 140 g of alkyl methacrylate having a carbon number of 12 to 15 (C12=21%, C13=29%, C14=25%, C15=25%; an average carbon number of 13.5), 60 g of mineral oil, and 0.5 g of lauryl mercaptan as a chain transfer agent were added, and the air in the reaction vessel was replaced with nitrogen. Subsequently, the reaction mixture was heated to 70° C., and 0.3 g of azobisisobutyronitrile as a polymerization initiator was added. The mixture was aged at 80° C. for 5 hours to obtain polyalkyl methacrylate having a weight average molecular weight of about 80,000. The compound obtained from the operation was defined as Polymer (A1).

Synthetic Example 2

Polymer (A2) having a weight average molecular weight of about 80,000 was obtained by performing a polymerization in a similar method as in Synthetic Example 1 except that 140 g of alkyl methacrylate having a carbon number of 12 to 18 (C10=15%, C12=30%, C14=30%, C16=25%; an average carbon number of 13.3) was used.

Synthetic Example 3

Polymer (A3) having a weight average molecular weight of about 80,000 was obtained by performing a polymerization in a similar method as in Synthetic Example 1 except that 140 g of alkyl methacrylate having a carbon number of 8 to 18 (C8=5%, C10=30%, C12=40%, C14=10%, C16=5%, C18=40%; an average carbon number of 12.2) was used.

Synthetic Example 4

Polymer (B1) having a weight average molecular weight of about 80,000 was obtained by performing a polymerization in a similar method as in Synthetic Example 1 except that 140 g of alkyl methacrylate having a carbon number of 12 to 18 (C12=14%, C13=20%, C14=18%, C15=18%, C16=10%, C18=20%; an average carbon number of 14.7) was used.

Synthetic Example 5

Polymer (B2) having a weight average molecular weight of about 80,000 was obtained by performing a polymerization in a similar method as in Synthetic Example 1 except that 140 g of alkyl methacrylate having a carbon number of 12 to 18 (C12=6%, C13=9%, C14=8%, C15=8%, C16=23%, C18=46%; an average carbon number of 16.2) was used.

The relations of mixing ratio of Polymers A1 to B2 in Compositions 1 to 11 are shown in Table 1.

TABLE 1

| | | Polymer Polymerized in Synthetic Example and Mixing Ratio (% by weight) | | | | | |
|---|---|---|---|---|---|---|---|
| | | A1 | A2 | A3 | B1 | B2 | Difference of Average Carbon Number |
| | | Average Carbon Number | | | | | |
| | | 13.5 | 13.3 | 12.2 | 14.7 | 16.2 | |
| Example 1 | Composition 1 | 30 | — | — | 70 | — | 1.2 |
| Example 2 | Composition 2 | 50 | — | — | 50 | — | 1.2 |
| Example 3 | Composition 3 | 70 | — | — | 30 | — | 1.2 |
| Example 4 | Composition 4 | — | 30 | — | 70 | — | 1.4 |
| Example 5 | Composition 5 | — | 50 | — | 50 | — | 1.4 |
| Example 6 | Composition 6 | — | 70 | — | 30 | — | 1.4 |
| Comparative Example 1 | Composition 7 | 100 | — | — | — | — | — |
| Comparative Example 2 | Composition 8 | — | — | — | 100 | — | — |
| Comparative Example 3 | Composition 9 | 50 | — | — | — | 50 | 2.7 |
| Comparative Example 4 | Composition 10 | — | 50 | | — | 50 | 2.9 |
| Comparative Example 5 | Composition 11 | — | — | 50 | — | 50 | 4.0 |

To each of Solvent Refined Base Oil (1) (a kinetic viscosity of 23 mm2/s, 40° C., a viscosity index of 101), Solvent Refined Base Oil (2) (a kinetic viscosity of 31 mm2/s, 40° C., a viscosity index of 106), High Viscosity Index Base Oil (3) (a kinetic viscosity of 20 mm2/s, 40° C., a viscosity index of 122), and High Viscosity Index Base Oil (4) (a kinetic viscosity of 37 mm2/s, 40° C., a viscosity index of 131), 0.5% by mass of a pour point depressant composed of each of Compositions 1 to 11 shown in Table 1 was added, and pour point measurement tests were performed. The obtained results are shown in Tables 2 and 3.

TABLE 2

| | | Measurement Result of Pour Point (° C.) Base Oil Used | |
|---|---|---|---|
| | | (1) | (2) |
| Without Composition | | −12.5 | −12.5 |
| | Composition Used | Composition Addition Amount of 0.5% by weight | |
| Example 1 | Composition 1 | −40.0 | −40.0 |
| Example 2 | Composition 2 | −42.5 | −40.0 |
| Example 3 | Composition 3 | −42.5 | −42.5 |
| Example 4 | Composition 4 | −40.0 | −40.0 |
| Example 5 | Composition 5 | −40.0 | −40.0 |
| Example 6 | Composition 6 | −42.5 | −42.5 |
| Comparative Example 1 | Composition 7 | −17.5 | −12.5 |
| Comparative Example 2 | Composition 8 | −35.0 | −35.0 |
| Comparative Example 3 | Composition 9 | −30.0 | −30.0 |
| Comparative Example 4 | Composition 10 | −32.5 | −25.0 |
| Comparative Example 5 | Composition 11 | −30.0 | −20.0 |

TABLE 3

| | | Measurement Result of Pour Point (° C.) Base Oil Used | |
|---|---|---|---|
| | | (3) | (4) |
| Without Composition | | −15.0 | −12.5 |
| | Composition Used | Composition Addition Amount of 0.5% by weight | |
| Example 1 | Composition 1 | −45.0 | −2.5 |
| Example 2 | Composition 2 | −47.5 | −42.5 |

TABLE 3-continued

| | | Measurement Result of Pour Point (° C.) Base Oil Used | |
|---|---|---|---|
| | | (3) | (4) |
| Example 3 | Composition 3 | −47.5 | −40.0 |
| Example 4 | Composition 4 | −45.0 | −40.0 |
| Example 5 | Composition 5 | −45.0 | −42.5 |
| Example 6 | Composition 6 | −45.0 | −40.0 |
| Comparative Example 1 | Composition 7 | −32.5 | −15.0 |
| Comparative Example 2 | Composition 8 | −35.0 | −32.5 |
| Comparative Example 3 | Composition 9 | −35.0 | −35.0 |
| Comparative Example 4 | Composition 10 | −37.5 | −30.0 |
| Comparative Example 5 | Composition 11 | −37.5 | −32.5 |

These results reveal that the additive of the present invention has an effect of significantly lowering pour points of lubricants in which solvent refined base oils or high viscosity index base oils are used even if the addition amount is low.

The invention claimed is:

1. A pour point depressant for lubricants comprising:

a mixture of an alkyl (meth)acrylate polymer (A) that is composed of an alkyl (meth)acrylate containing alkyl groups having an average carbon number ($C_A$) of 12.5 to 13.8, and is a polymer in which, with the alkyl (meth) acrylate that composes the polymer (A) being 100% by mass, 30 to 80% by mass of the alkyl (meth)acrylate is composed of an alkyl (meth)acrylate containing alkyl groups having a carbon number of 13 or less, and an alkyl (meth)acrylate polymer (B) that is composed of an alkyl (meth)acrylate containing alkyl groups having an average carbon number ($C_B$) of 13.9 to 15.5, and is a polymer in which, with the alkyl (meth)acrylate that composes the polymer (B) being 100% by mass, 5 to 60% by mass of the alkyl (meth)acrylate is composed of an alkyl (meth)acrylate containing alkyl groups having a carbon number of 13 or less, wherein a relation between $C_A$ and $C_B$ satisfies Formula (1):

$$0.5 \leqq C_B - C_A \leqq 2.5 \quad (1).$$

2. The pour point depressant for lubricants according to claim 1, wherein a mass ratio of the polymer (A) and the polymer (B) is (A)/(B)=1/99 to 99/1.

3. A lubricant comprising:

0.01% by mass to 5.0% by mass of the pour point depressant for lubricants as claimed in claim 1.

4. A lubricant comprising:

0.01% by mass to 5.0% by mass of the pour point depressant for lubricants as claimed in claim 2.

* * * * *